US007154229B2

(12) United States Patent
Alexandrov et al.

(10) Patent No.: US 7,154,229 B2
(45) Date of Patent: Dec. 26, 2006

(54) ELECTRONIC BALLAST WITH LOAD SHED CIRCUIT

(75) Inventors: Felix I. Alexandrov, Bedford, MA (US); Joseph L. Parisella, Beverly, MA (US); Thomas J. Schalton, Beverly, MA (US)

(73) Assignee: Osram Sylvania, Inc., Danvers, MA (US)

( * ) Notice: Subject to any disclaimer, the term of this patent is extended or adjusted under 35 U.S.C. 154(b) by 0 days.

(21) Appl. No.: 10/982,379

(22) Filed: Nov. 4, 2004

(65) Prior Publication Data

US 2006/0091818 A1 May 4, 2006

(51) Int. Cl.
*H05B 39/04* (2006.01)

(52) U.S. Cl. ..... 315/209 R; 315/307; 315/294; 315/291; 315/324

(58) Field of Classification Search ..... 315/291, 315/307, 224, 225, DIG. 7, 209 R, 276, 283, 315/294–295, 324
See application file for complete search history.

(56) References Cited

U.S. PATENT DOCUMENTS

| | | | | |
|---|---|---|---|---|
| 5,227,762 | A | 7/1993 | Guidette et al. | 340/310 |
| 5,440,440 | A | 8/1995 | Du | 361/18 |
| 5,689,230 | A | 11/1997 | Merwin et al. | 340/310 |
| 6,157,142 | A * | 12/2000 | Moisin | 315/307 |
| 6,316,886 | B1 * | 11/2001 | Luger et al. | 315/307 |
| 6,545,432 | B1 * | 4/2003 | Konopka | 315/291 |
| 6,583,573 | B1 | 6/2003 | Bierman | 315/149 |
| 6,873,121 | B1 * | 3/2005 | Stevens | 315/307 |
| 2003/0102979 | A1 | 6/2003 | Jednacz et al. | 340/825 |
| 2003/0189495 | A1 | 10/2003 | Pettler et al. | 340/854 |
| 2003/0222603 | A1 | 12/2003 | Mogilner et al. | 315/294 |
| 2004/0002792 | A1 | 1/2004 | Hoffknecht | 700/295 |

* cited by examiner

*Primary Examiner*—Hoang V. Nguyen
*Assistant Examiner*—Chuc Tran
(74) *Attorney, Agent, or Firm*—Fitch, Even, Tabin & Flannery; Kenneth D. Labudda

(57) ABSTRACT

An electronic ballast (10) for powering at least one gas discharge lamp (30) includes a current-fed resonant inverter (300) and a load shed circuit (600). Inverter (300) ordinarily powers the lamp at a first level. When a load shed command is sent by the electric utility and received by an associated load shed receiver within the ballast (10), load shed circuit (600) causes the inverter to reduce the lamp power from the first level to a second level. Preferably, load shed circuit (600) includes an isolation circuit (620) and a bidirectional switch (640) that is coupled in parallel with a return ballasting capacitor (388) within inverter (300). In the absence of a load shed command, bidirectional switch (640) effectively shunts return ballasting capacitor (388), which causes the lamp to be powered at the first level. In response to a load shed command, bidirectional switch (640) ceases to shunt return ballasting capacitor (388), thereby causing the lamp power to be reduced to the second level.

25 Claims, 4 Drawing Sheets

ELECTRONIC BALLAST WITH LOAD SHED CIRCUIT

FIELD OF THE INVENTION

The present invention relates to the general subject of circuits for powering discharge lamps. More particularly, the present invention relates to an electronic ballast that includes a load shed circuit.

BACKGROUND OF THE INVENTION

Load shedding is commonly employed by electric utilities during periods (e.g., hot summer days) when the amount of power demanded from the electric utility is extraordinarily high. Typically, electric utility companies offer monetary incentives to certain high demand customers, such as factories and office buildings, in order to allow the electric utility to reduce the amount of power delivered to those customers during periods of high power demand.

Fluorescent lighting accounts for a significant portion of the total power that is demanded from an electric utility. Accordingly, fluorescent lighting systems that accommodate load shedding by dimming the lamps (thus reducing the amount of power) in response to a load shed command are very desirable.

Fluorescent lamps require ballasts that provide a high voltage for igniting the lamps, as well as a magnitude-limited current for operating the lamps at an appropriate power level. As compared with conventional "core and coil" magnetic ballasts, electronic ballasts are known to provide enhanced energy efficiency and other benefits (e.g., negligible visible flicker). However, electronic ballasts are more difficult to control than magnetic ballasts, especially in dimming applications.

Electronic dimming ballasts are well known in the art. Dimming ballasts typically include a high frequency inverter and complex circuitry for precisely controlling (e.g., via frequency or duty cycle control) the amount of power that the inverter delivers to the lamps. Additionally, dimming ballasts typically require dedicated low voltage wiring for receiving an input from a special dimming controller. As a result, electronic dimming ballasts are generally much more expensive (in terms of both material and installation costs) than ordinary fixed light output electronic ballasts. Consequently, dimming ballasts account for but a small fraction of the electronic ballasts that are currently in use.

What is needed, therefore, is an electronic ballast that includes economical load shed circuitry for reducing power consumption in response to a load shed command from an electric utility. Such a ballast would represent a significant advance over the prior art.

DETAILED DESCRIPTION OF THE PREFERRED EMBODIMENTS

Figure 1:
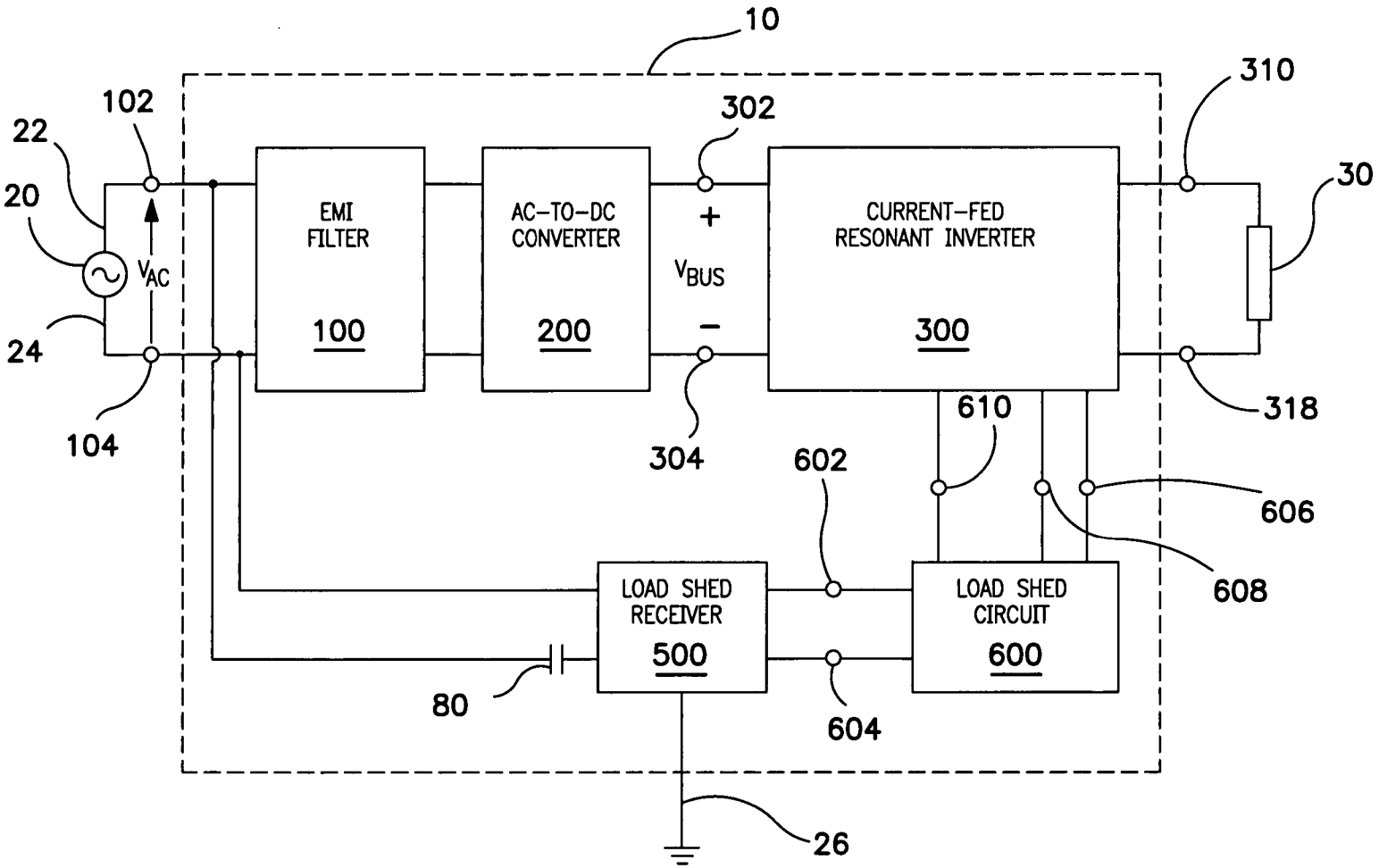
FIG. 1 is a block diagram schematic of an electronic ballast with a load shed circuit, in accordance with a preferred embodiment of the present invention.

An electronic ballast 10 for powering at least one gas discharge lamp 30 is described in FIG. 1. Ballast 10 comprises a current-fed resonant inverter 300 and a load shed circuit 600. Inverter 300 is adapted for connection to lamp 30. During operation, inverter 300 provides a lamp power to lamp 30. Load shed circuit 600 is coupled to inverter 300. During operation, in the absence of a load shed command, inverter 300 operates lamp 30 at a lamp power corresponding to a first value (e.g., corresponding to 100% of rated light output). Conversely, in response to a load shed command, load shed circuit 600 causes inverter 300 to reduce the lamp power from the first value to a second value (e.g., corresponding to 70% of rated light output) that is less than the first value.

As described in FIG. 1, ballast 10 further includes input terminals 102,104, an electromagnetic interference (EMI) filter 100, an AC-to-DC converter 200, and a load shed receiver 500. Input terminals 102,104 are adapted for coupling to a conventional source of alternating current (AC) voltage, $V_{AC}$ (e.g., 120 volts rms at 60 hertz), as provided by an electric utility company. First input terminal 102 is adapted for coupling to a hot lead 22 of AC source 20, while second input terminal 104 is adapted for coupling to a neutral lead 24 of AC source 20.

EMI filter 100 and AC-to-DC converter 200 may be realized by any of a number of arrangements that are well known to those skilled in the art of power supplies and/or electronic ballasts. For instance, AC-to-DC converter 200 may be implemented by a combination that includes a full-wave diode bridge rectifier circuit followed by a power factor corrected boost converter. During operation, AC-to-DC converter receives the AC input voltage, $V_{AC}$, and provides a substantially direct current (DC) bus voltage, $V_{BUS}$, at its output.

Load shed receiver 500 is coupled to input terminals 102,104 via a coupling capacitor 80, as well as to earth ground 26. During operation, load shed receiver 500 monitors $V_{AC}$ to detect a load shed command that is transmitted by the electric utility along the AC power line. In response to a load shed command, load shed receiver 500 provides an appropriate signal (e.g., a low level positive voltage) to load shed circuit 600 via connections 602,604. Coupling capacitor 80 serves to protect load shed receiver 500 from low frequency (e.g., 60 hertz) AC line voltage. Load shed receiver 500 may be realized by any of a number of circuits, the exact nature of which is dependent upon the characteristics of the signal that is inserted onto the AC power line to represent a load shed command. For purposes of the present invention, it is important only that load shed receiver 500 provide an output signal between connections 602,604 that differs in dependence on whether or not a load shed command is present on the AC line. As but one example, load shed receiver 500 will properly function with load shed circuit 600 as disclosed herein if load shed receiver 500 provides an output voltage between connections 602,604 that, in the absence of a load shed command, is at approximately zero volts, and that, in the presence of a load shed command, is at approximately +5 volts.

Figure 2:
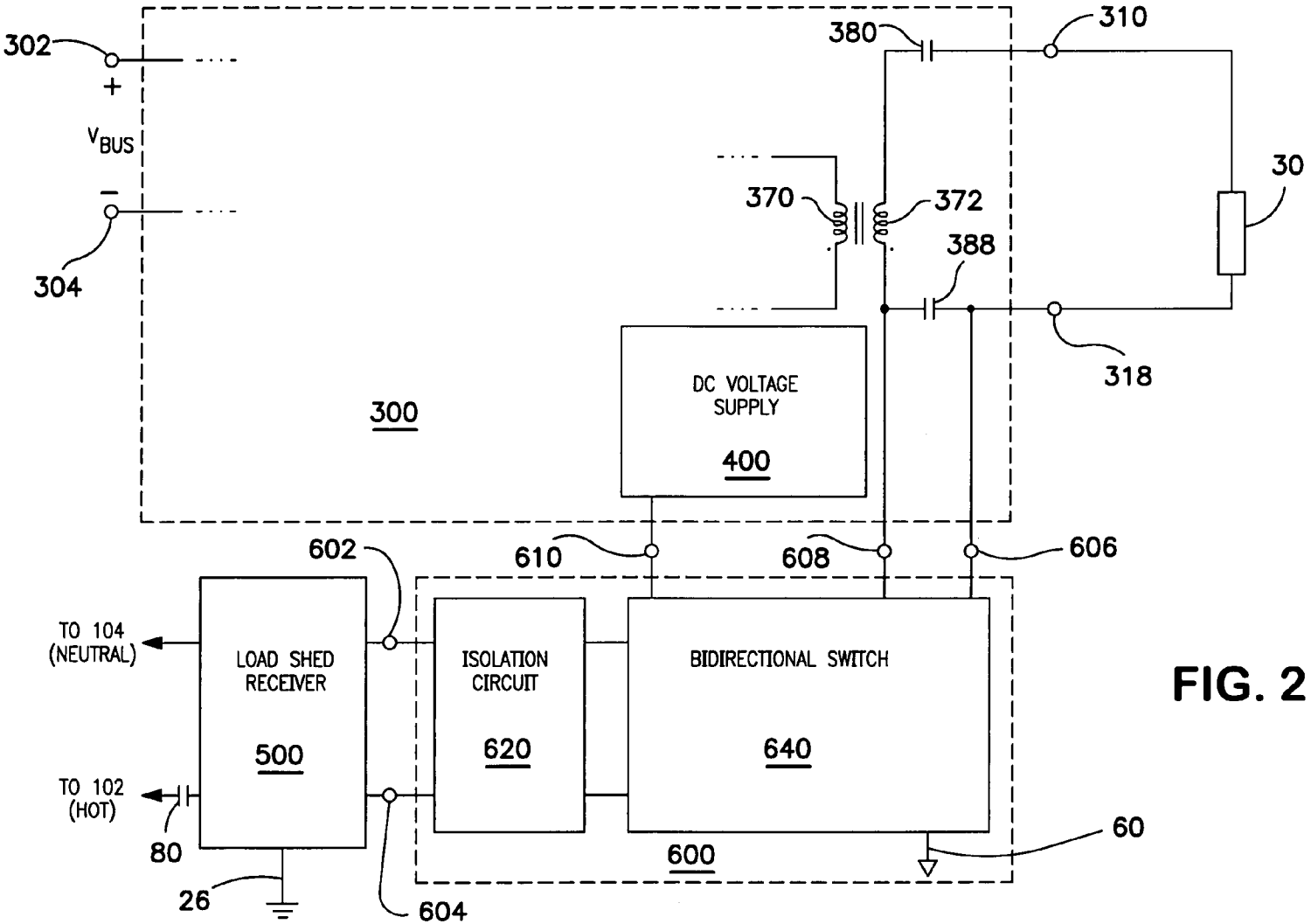
FIG. 2 is a block diagram schematic of a portion of an electronic ballast that includes a load shed circuit and that is adapted to power at least one fluorescent lamp, in accordance with a preferred embodiment of the present invention.

Referring now to FIG. 2, in a preferred embodiment of the present invention, current-fed resonant inverter 300 comprises a pair of input terminals 302,304, a first output terminal 310, a return output terminal 318, a first ballasting capacitor 380, a return ballasting capacitor 388, and an output transformer having a primary winding 370 and a secondary winding 372. Input terminals 302,304 receive a source of substantially direct current (DC) voltage $V_{BUS}$. First output terminal 310 and return output terminal 318 are adapted for connection to lamp 30. First ballasting capacitor 380 is coupled between secondary winding 372 and first output terminal 310. Return ballasting capacitor 388 is coupled between secondary winding 372 and return output terminal 318.

During operation, inverter 300 provides a high voltage for igniting lamp 30 and a magnitude-limited current for powering lamp 30. In the absence of a load shed command, inverter 300 operates lamp 30 at a first power level (such as that which corresponds to the rated current or rated light output of the lamp). When a load shed command occurs, inverter 300 operates lamp 30 at a second power level that is less than the first power level.

Referring again to FIG. 2, in a preferred embodiment of the present invention, load shed circuit 600 comprises input connections 602,604, output connections 606,608, an isolation circuit 620, and a bidirectional switch 640. Input connections 602,604 are adapted for coupling to load shed receiver 500. Output connections 606,608 are coupled to inverter 300.

Isolation circuit 620 is adapted for coupling to load shed receiver 500 via input connections 602,604. Isolation circuit 620 serves to provide a logic level control signal (the value of which is dependent upon whether or not a load shed command is present on the AC power line) that is isolated from the AC power line and that is properly referenced with respect to circuit common 60.

Bidirectional switch 640 is coupled to isolation circuit 620 and includes first and second output connections 606, 608 coupled in parallel with return ballasting capacitor 388. More particularly, first output connection 606 is coupled to return output terminal 318, while second output connection 608 is coupled to a junction between secondary winding 372 and return ballasting capacitor 388. During operation, in the absence of a load shed command, bidirectional switch 640 provides an effective short circuit between first and second output connections 606,608, thereby shunting return ballasting capacitor 388 and causing lamp 30 to be powered at the first level. In response to a load shed command, bidirectional switch 640 ceases to provide an effective short circuit between first and second output connections 606,608, thereby ceasing to shunt return ballasting capacitor 388 and causing lamp 30 to be powered at the second (i.e., lower) level.

As described in FIG. 2, inverter 300 preferably includes a DC voltage supply 400 for providing an isolated low level DC operating voltage (e.g., +5 volts) to bidirectional switch 640. Correspondingly, bidirectional switch 640 preferably further includes an auxiliary input connection 610 coupled to DC voltage supply 400.

Figure 3:
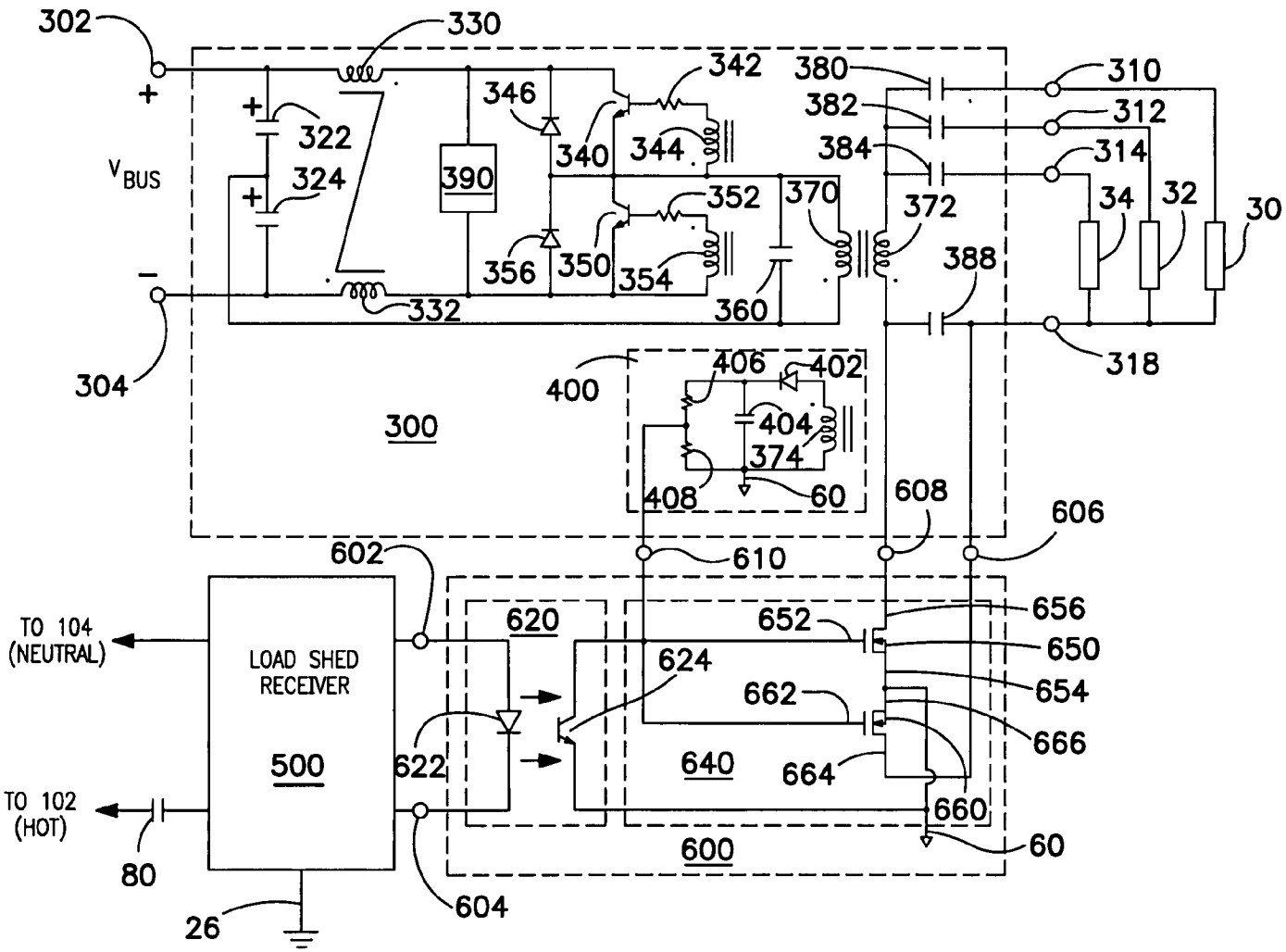
FIG. 3 is a detailed electrical schematic of a portion of an electronic ballast that includes a load shed circuit and that is adapted to power three fluorescent lamps, in accordance with a preferred embodiment of the present invention.

Specific circuitry for implementing inverter 300 and load shed circuit 600 is described in FIG. 3, which illustrates a preferred ballast that is adapted for powering three lamps 30,32,34.

Inverter 300 is preferably realized as a current-fed self-oscillating parallel resonant half-bridge inverter. As described in FIG. 3, inverter 300 comprises input terminals 302,304, first output terminal 310, second output terminal 312, third output terminal 314, return output terminal 318, bulk capacitors 322,324, a current-feed inductor having upper and lower windings 330,332, inverter transistors 340, 350, base drive resistors 342,352, base drive windings 344,354, antiparallel diodes 346,356, resonant capacitor 360, an output transformer comprising a primary winding 370 and a secondary winding 372, a first ballasting capacitor 380, a second ballasting capacitor 382, a third ballasting capacitor 384, a return ballasting capacitor 388, and a voltage clamping element 390 (e.g., a varistor). Base drive windings 344,354 are magnetically coupled to primary winding 370 and secondary winding 372 of the output transformer; in practice, base drive windings 344,354 are wound around the same bobbin and core as primary winding 370 and secondary winding 372 of the output transformer.

As illustrated in FIG. 3, first ballasting capacitor 380 is coupled between secondary winding 372 and first output terminal 310, second ballasting capacitor 382 is coupled between secondary winding 372 and second output terminal 312, third ballasting capacitor 384 is coupled between secondary winding 372 and third output terminal 314, and return ballasting capacitor 388 is coupled between secondary winding 372 and return output terminal 318. Lamps 30,32,34 are coupled to output terminals 310,312,314,318 in a parallel manner; more specifically, first lamp 30 is coupled between first output terminal 310 and return output terminal 318, second lamp 32 is coupled between second output terminal 312 and return output terminal 318, and third lamp 34 is coupled between third output terminal 314 and return output terminal 318.

As the basic operation of inverter 300 is well known to those skilled in the art of electronic ballasts, it will not be elaborated upon herein. Nevertheless, for purposes of understanding the present invention, it is important to appreciate that the current (and hence the power) delivered to lamps 30,32,34 is dependent upon a number of parameters, including the inverter operating frequency, the capacitances of ballasting capacitors 380,382,384,388, and the operating state of bidirectional switch 600.

DC voltage supply 400 comprises an auxiliary winding 374, a rectifier 402, a capacitor 404, and a series combination of a first resistor 406 and a second resistor 408. Auxiliary winding 374 is magnetically coupled to primary winding 370 and secondary winding 372 of the output transformer; in practice, auxiliary winding 374 is wound around the same bobbin and core as primary winding 370 and secondary winding 372. Rectifier 402 is coupled to auxiliary winding 374. Capacitor 404 is coupled to rectifier 402 and to a circuit common 60. The series combination of first resistor 406 and second resistor 408 is coupled in parallel with capacitor 404. The junction of first resistor 406 and second resistor 408 is coupled to auxiliary input connection 610 of bidirectional switch 600. During operation, DC voltage supply 400 provides a low level bias voltage (e.g., +5 volts) for operating bidirectional switch 640.

Isolation circuit 620 is preferably implemented by an optocoupler (e.g., a 4N25 optocoupler integrated circuit) comprising a light emitting diode 622 and a photosensitive transistor 624. Bidirectional switch 640 preferably comprises a first transistor 650 and a second transistor 660, each of which is preferably implemented by a N-channel field effect transistor (e.g., a STD5NM50 transistor). First transistor 650 has a gate 652, a source 654, and a drain 656. Second transistor 660 has a gate 662, a drain 664, and a source 666. Gate 652 of first transistor 650 and gate 662 of second transistor 660 are coupled to each other and to isolation circuit 620, as well as to auxiliary input connection 610. Source 654 of first transistor 650 is coupled to source 666 of second transistor 660 and to circuit common 60. Drain 656 of first transistor 650 is coupled to second output connection 608. Drain 664 of second transistor 660 is coupled to first output connection 606.

During operation, in the absence of a load shed command, load shed receiver 500 provides a low level logic signal (e.g., zero volts) between input connections 602,604. Consequently, diode 622 does not emit sufficient (or any) light and transistor 624 is off. With transistor 624 off, the gates 652,662 of transistors 650,660 will be at the voltage (e.g., +5 volts) provided by DC supply 400, thus causing transistors 650,660 to be on and to provide an effective short circuit between output connections 606,608, thereby shunting return ballasting capacitor 388. Correspondingly, the current/power to the lamps will be at its maximum (e.g., rated) level.

Conversely, when a load shed command occurs, load shed receiver 500 provides a positive voltage (e.g., +5 volts) between input connections 602,604. Correspondingly, diode 622 emits sufficient light to effectuate turn on of transistor 624. With transistor 624 turned on, the voltage at the gates 652,662 of transistors 650,660 is pulled down to circuit common (i.e., zero volts), thus causing transistors 650,660 to turn off and cease to shunt return ballasting capacitor 388. With the added impedance of ballasting capacitor 388 now in circuit, the current/power to the lamps will be reduced to a level (e.g., 70% of rated light output) that is less than the maximum level.

Transistors 650,660 will remain off, and the lamps will continue to be operated at a reduced power level, for as long as the load shed command is present. When the load shed command ceases, transistors 650,660 will turn back on and shunt ballasting capacitor 388, thereby operating the lamps at the maximum (e.g., rated) current/power level.

In a prototype ballast configured substantially as described in FIG. 3, capacitors 380,382,384 had a capacitance of 1200 picofarads, and capacitor 388 had a capacitance of 3300 picofarads. In the absence of a load shed command, the inverter oscillated at a frequency of about 42 kilohertz, and the lamp current was about 180 milliamperes rms. In response to a load shed command, the lamp current was reduced to about 120 milliamperes rms.

Figure 4:
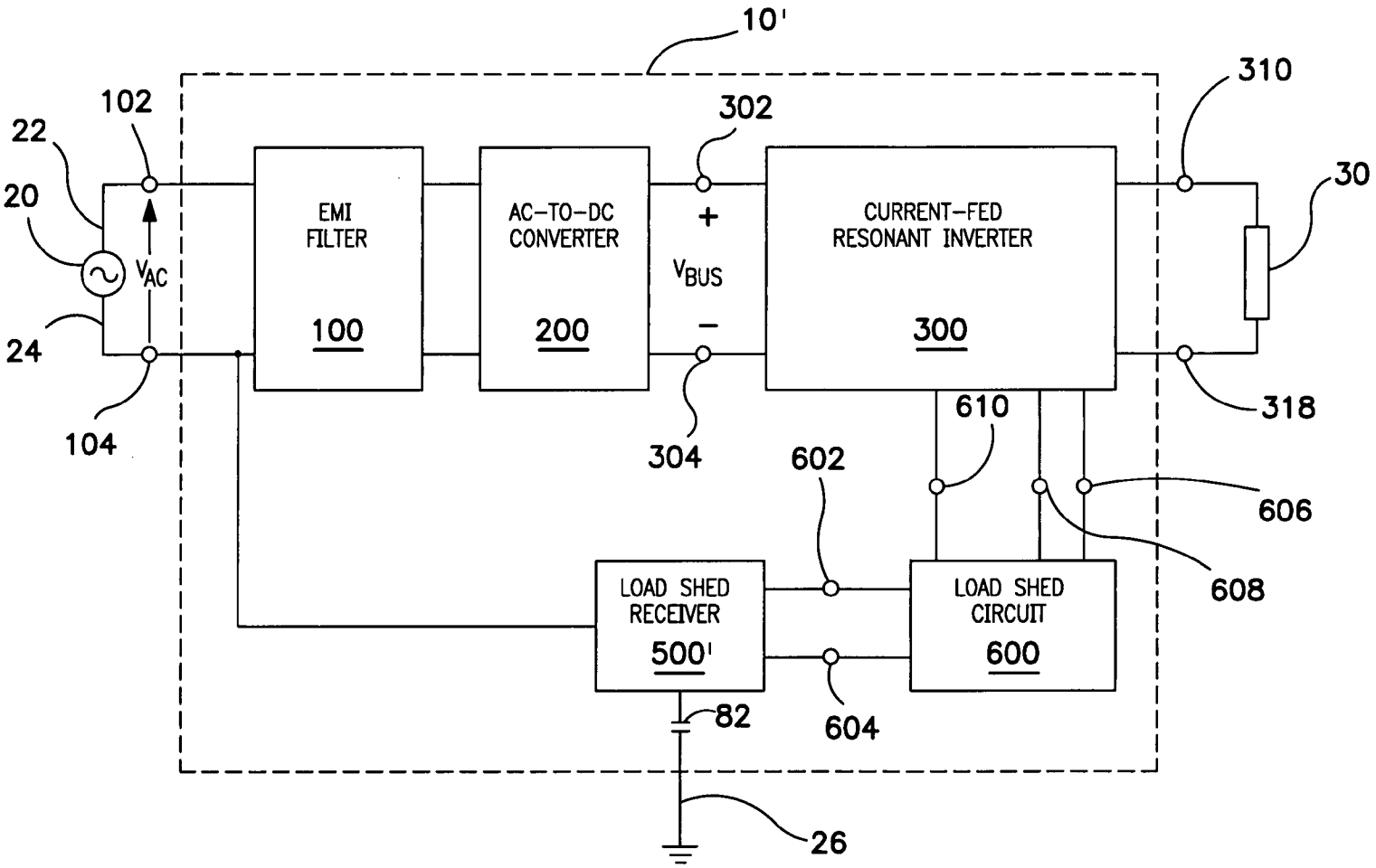
FIG. 4 is a block diagram schematic of an electronic ballast that includes a load shed receiver that is coupled to AC neutral and earth ground, in accordance with an alternative preferred embodiment of the present invention.

FIG. 4 describes an alternative ballast 10' wherein the load shed receiver 500' may be referenced to earth ground 26. This alternative arrangement has the advantage of requiring only one connection between the load shed receiver and the AC line source. More specifically, in ballast 10', load shed receiver 500' is coupled to the neutral lead 24 of AC source 20. Load shed receiver 500' is coupled to earth ground 26 via coupling capacitor 82. In contrast with ballast 10 in FIG. 1, ballast 10' does not require any connection between load shed receiver 500' and the hot lead 22 of AC source 20. Consequently, the components within load shed receiver 500' are not exposed to the high voltages that can exist between the hot and neutral leads 22,24, thus making it possible to realize load shed receiver 500' in an even more cost-effective manner than load shed receiver 500. Other than the aforementioned difference, ballast 10' may be realized using the same circuitry that has already been described with reference to FIGS. 2 and 3.

Although the present invention has been described with reference to certain preferred embodiments, numerous modifications and variations can be made by those skilled in the art without departing from the novel spirit and scope of this invention.

What is claimed is:

1. A ballast for powering at least one gas discharge lamp, the ballast comprising:

a current-fed resonant inverter adapted for connection to the at least one gas discharge lamp and operable to provide a lamp power to the lamp, the lamp power having a first value and a second value, wherein the second value is less than the first value; and a load shed circuit coupled to the inverter and operable, in response to a load shed command, to cause to the inverter to reduce the lamp power from the first level to the second level, wherein:

the current-fed resonant inverter comprises:

a pair of input terminals adapted to receive a substantially direct current (DC) voltage;

a first output terminal and a return output terminal, wherein the first output terminal and the return output terminal are adapted for connection to the lamp; and a first ballasting capacitor and a return ballasting capacitor, wherein the first ballasting capacitor is coupled to the first output terminal, and the return ballasting capacitor is coupled to the return output terminal; and the load shed circuit comprises:

an isolation circuit adapted for coupling to a load shed receiver; and a bidirectional switch coupled to the isolation circuit, the bidirectional switch including first and second output connections coupled in parallel with the return ballasting capacitor.

2. The ballast of claim 1, wherein the bidirectional switch is operable:

(i) in the absence of a load shed command, to provide an effective short circuit between the first and second output connections, thereby shunting the return ballasting capacitor and causing the lamp to be powered at the first level; and (ii) in response to a load shed command, to cease to provide an effective short circuit between the first and second output connections, thereby ceasing to shunt the return ballasting capacitor and causing the lamp to be powered at the second level.

3. The ballast of claim 1, wherein the isolation circuit comprises an optocoupler.

4. The ballast of claim 1, wherein the bidirectional switch further comprises a first transistor and a second transistor, each transistor having a gate, a source, and a drain, wherein:

the gate of the first transistor and the gate of the second transistor are coupled to each other and to the isolation circuit;

the source of the first transistor is coupled to the source of the second transistor and to a circuit common;

the drain of the first transistor is coupled to the second output connection; and the drain of the second transistor is coupled to the first output connection.

5. The ballast of claim 4, wherein the first transistor and the second transistor are N-channel field effect transistors.

6. The ballast of claim 1, wherein the inverter further comprises a DC voltage supply coupled to the bidirectional switch.

7. A ballast for powering at least one gas discharge lamp, the ballast comprising:

a current-fed resonant inverter adapted for connection to the at least one gas discharge lamp and operable to provide a lamp power to the lamp, the lamp power having a first value and a second value, wherein the second value is less than the first value; and a load shed circuit coupled to the inverter and operable, in response to a load shed command, to cause to the inverter to reduce the lamp power from the first level to the second level, wherein:

the inverter comprises:

a pair of input terminals for receiving a source of substantially direct current (DC) voltage;

a first output terminal and a return output terminal, wherein the first output terminal and the return output terminal are adapted for connection to the at least one gas discharge lamp;

an output transformer having a primary winding and a secondary winding; and a first ballasting capacitor and a return ballasting capacitor, wherein the first ballasting capacitor is coupled between the secondary winding and the first output terminal, and the return ballasting capacitor is coupled between the secondary winding and the return output terminal; and the load shed circuit comprises:

an isolation circuit coupled to a load shed receiver; and a bidirectional switch coupled to the isolation circuit, the bidirectional switch including first and second output connections, wherein the first output connection is coupled to the return output terminal, and the second output connection is coupled to a junction of the secondary winding and the return ballasting capacitor.

8. The ballast of claim 7, wherein the isolation circuit comprises an optocoupler.

9. The ballast of claim 7, wherein the bidirectional switch further comprises a first transistor and a second transistor, each transistor having a gate, a source, and a drain, wherein:

the gate of the first transistor and the gate of the second transistor are coupled to each other and to the isolation circuit;

the source of the first transistor is coupled to the source of the second transistor and to a circuit common;

the drain of the first transistor is coupled to the second output connection; and the drain of the second transistor is coupled to the first output connection.

10. The ballast of claim 9, wherein the first transistor and the second transistor are N-channel field effect transistors.

11. The ballast of claim 9, wherein the inverter further comprises a DC voltage supply, comprising:

an auxiliary winding that is magnetically coupled to the primary and secondary windings of the output transformer;

a rectifier coupled to the auxiliary winding;

a capacitor coupled to the rectifier and to circuit common; and a series combination of a first resistor and a second resistor, the series combination being coupled in parallel with the capacitor, wherein a junction of the first resistor and the second resistor is coupled to the gates of the first and second transistors of the bidirectional switch.

12. A ballast for powering a lamp load comprising at least one gas discharge lamp, the ballast comprising:

a current-fed resonant inverter, comprising:

a first output terminal and a return output terminal, wherein the first output terminal and the return output terminal are adapted for connection to a first gas discharge lamp; and a first ballasting capacitor and a return ballasting capacitor, wherein the first ballasting capacitor is coupled to the first output terminal, and the return ballasting capacitor is coupled to the return output terminal; and a load shed circuit adapted for connection to a load shed receiver, the load shed circuit having output connections coupled in parallel with the return ballasting capacitor, wherein the load shed circuit is operable:

(i) in the absence of a load shed command, to provide an approximate short circuit between the output connections, thereby shunting the return ballasting capacitor and causing the inverter to operate the lamp at a first power level; and (ii) in response to a load shed command, to cease to provide an approximate open circuit between the output connections, thereby ceasing to shunt the return ballasting capacitor, thereby causing the inverter to operate the lamp at a second power level that is less than the first power level.

13. The ballast of claim 12, wherein the load shed circuit comprises:

an isolation circuit coupled to the load shed receiver; and a bidirectional switch coupled to the isolation circuit, the bidirectional switch including first and second output connections coupled in parallel with the return ballasting capacitor.

14. The ballast of claim 13, wherein the inverter is a current-fed parallel resonant half-bridge inverter.

15. The ballast of claim 13, wherein the inverter further comprises:

a second output terminal adapted for connection to a second gas discharge lamp, wherein the second lamp is coupled between the second output terminal and the return output terminal; and a second ballasting capacitor coupled between the secondary winding and the second output terminal.

16. The ballast of claim 15, wherein the inverter further comprises:

a third output terminal adapted for connection to a third gas discharge lamp, wherein the third lamp is coupled between the third output terminal and the return output terminal; and a third ballasting capacitor coupled between the secondary winding and the third output terminal.

17. The ballast of claim 13, wherein the isolation circuit comprises an optocoupler.

18. The ballast of claim 13, wherein the bidirectional switch comprises:

first and second output connections coupled in parallel with the return ballasting capacitor, wherein the first output connection is also coupled to the return output terminal; and first and second transistors, each transistor having a gate, a source, and a drain, wherein:

the gate of the first transistor and the gate of the second transistor are coupled to each other and to the isolation circuit;

the source of the first transistor is coupled to the source of the second transistor and to a circuit common;

the drain of the first transistor is coupled to the second output connection; and the drain of the second transistor is coupled to the first output connection.

19. The ballast of claim 18, wherein the first transistor and the second transistor are N channel field effect transistors.

20. The ballast of claim 18, wherein the bidirectional switch further comprises an auxiliary input connection for receiving a low level DC voltage.

21. The ballast of claim 20, wherein the inverter further comprises a DC voltage supply coupled to the auxiliary input connection of the bidirectional switch.

22. A ballast for powering at least one gas discharge lamp, the ballast comprising:

an inverter, comprising:

input terminals for receiving a source of substantially direct current (DC) voltage;

an output transformer comprising a primary winding and a secondary winding;

a first output terminal and a return output terminal adapted for connection to a first gas discharge lamp;

a first ballasting capacitor coupled between the secondary winding and the first output terminal; and a return ballasting capacitor coupled between the secondary winding and the return output terminal; and a load shed circuit, comprising:

an isolation circuit comprising an optocoupler, wherein the optocoupler is adapted for coupling to a load shed receiver;

a bidirectional switch coupled to the isolation circuit, the bidirectional switch comprising:

a first output connection and a second output connection, wherein the first output connection is coupled to the first output terminal, and the second output connection is coupled to a junction of the secondary winding and the return ballasting capacitor; and a first transistor and a second transistor, each transistor having a gate, a source, and a drain, wherein: the gate of the first transistor and the gate of the second transistor are coupled to each other and to the isolation circuit; the source of the first transistor is coupled to the source of the second transistor and to a circuit common; the drain of the first transistor is coupled to the second output connection; and the drain of the second transistor is coupled to the first output connection.

23. The ballast of claim 22, wherein the inverter is a current-fed parallel resonant half-bridge inverter.

24. The ballast of claim 22, wherein the inverter further comprises:

a second output terminal adapted for connection to a second gas discharge lamp, wherein the second lamp is coupled between the second output terminal and the return output terminal; and a second ballasting capacitor coupled between the secondary winding and the second output terminal.

25. The ballast of claim 24, wherein the inverter further comprises:

a third output terminal adapted for connection to a third gas discharge lamp, wherein the third lamp is coupled between the third output terminal and the return output terminal; and a third ballasting capacitor coupled between the secondary winding and the third output terminal.

* * * * *